US006788075B2

(12) United States Patent
Hudson

(10) Patent No.: US 6,788,075 B2
(45) Date of Patent: Sep. 7, 2004

(54) ANODE MONITORING

(75) Inventor: Steven Martin Hudson, Sturminister Newton (GB)

(73) Assignee: Flight Refuelling Limited, Dorset (GB)

( * ) Notice: Subject to any disclaimer, the term of this patent is extended or adjusted under 35 U.S.C. 154(b) by 49 days.

(21) Appl. No.: 10/032,471

(22) Filed: Jan. 2, 2002

(65) Prior Publication Data

US 2002/0050830 A1 May 2, 2002

Related U.S. Application Data

(63) Continuation-in-part of application No. PCT/GB00/02493, filed on Jun. 23, 2000.

(30) Foreign Application Priority Data

Jul. 13, 1999 (GB) ..... 9916410
Jan. 3, 2001 (GB) ..... 0100104

(51) Int. Cl.[7] ..... G01R 27/08; G01R 31/08
(52) U.S. Cl. ..... 324/700; 324/531; 204/404
(58) Field of Search ..... 324/523, 527, 324/531, 700, 763, 365; 204/407

(56) References Cited

U.S. PATENT DOCUMENTS 4,090,170 A * 5/1978 Lincklaen-Arriens et al. ... 367/134
4,107,017 A * 8/1978 Sabins ..... 324/115
4,400,782 A * 8/1983 Ishikawa et al. ..... 324/72
4,826,577 A * 5/1989 Lange ..... 204/400
5,587,707 A 12/1996 Dickie et al. ..... 340/870.09
5,627,414 A * 5/1997 Brown et al. ..... 204/194

FOREIGN PATENT DOCUMENTS

EP 0 241 440 A2 10/1987
RU 2006953 1/1994

* cited by examiner

*Primary Examiner*—N. Le
*Assistant Examiner*—Timothy J. Dole
(74) *Attorney, Agent, or Firm*—Finnegan, Henderson, Farabow, Garrett & Dunner, L.L.P.

(57) ABSTRACT

An anode monitoring system for monitoring the integrity of anodes 2 provided on a metallic structure such as a pipeline system 1. A signal circuit $S_n$ including the pipeline 1 and one of the anodes 2 is set up and appropriate signals are looked for at a central station 4. Reception of the signal at the central station 4 is dependent on the integrity of the anode 2 under inspection at that time. If the anode 2 is missing or defective the expected signal is not received and thus the fault in the anode 2 can be detected. A notch filter 5 is inserted in series between each anode 2 and the pipeline 1. The filter 5 provides a high impedance which can be signalled across but does not interfere with the cathodic protection system.

25 Claims, 3 Drawing Sheets

Figure 1:
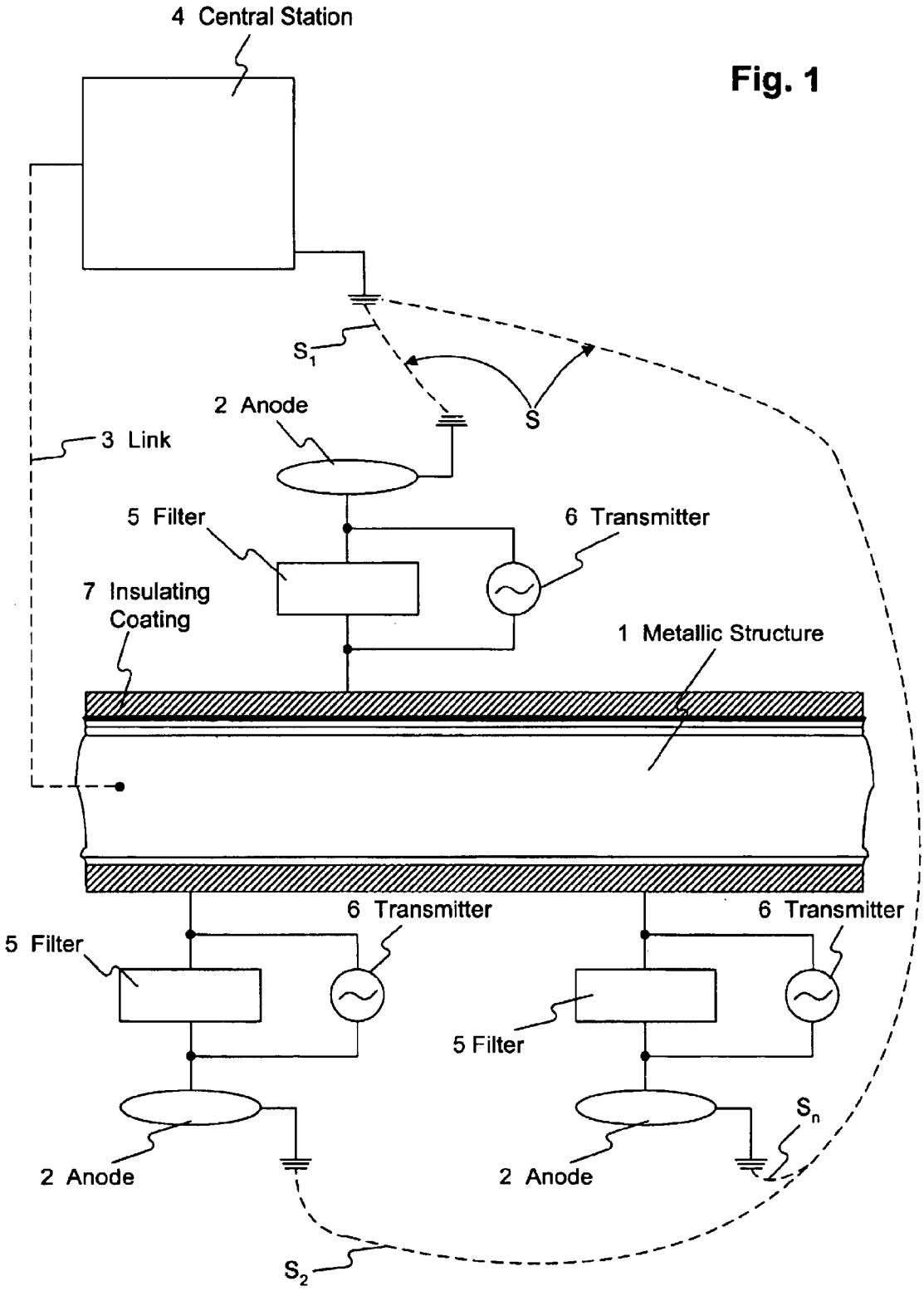

4 Central Station $S_1$
S
2 Anode
3 Link
5 Filter
6 Transmitter
7 Insulating Coating
1 Metallic Structure
6 Transmitter
6 Transmitter
5 Filter
5 Filter
$S_n$
2 Anode
2 Anode
$S_2$ 12
4
V
11
14 Tone Transmission Circuit
S
$S_1$
2 Anode
3 Link
13 Tone Detecting Circuit
5 Filter
10 Controller
7 Insulating Coating
9 Switch
1 Metallic Structure
13 Tone Detecting Circuit
10 Controller
13 Tone Detecting Circuit
10 Controller
5 Filter
9 Switch
5 Filter
9 Switch
$S_2$
2 Anode
2 Anode
$S_n$

ANODE MONITORING

CROSS REFERENCE TO RELATED APPLICATIONS

This application is a Continuation-In-Part of International Patent Application No. PCT/GB00/02493, filed Jun. 23, 2000, claiming priority of Great Britain Patent Application No. 9916410.5, filed Jul. 13, 1999, and Great Britain Patent Application No. 0100104.9, filed Jan. 3, 2001.

This invention relates to anode monitoring systems and anode monitoring methods for monitoring the integrity of anodes provided on a metallic structure for cathodic protection purposes. Examples of such structures are pipelines and components used with pipeline systems such as trees, manifolds and processing plants. This invention also relates to subsea pipeline power transmission systems, methods and apparatus.

The term subsea is used in this application as this is conventional terminology, however, it will be understood that this covers any underwater situation.

A subsea pipeline is typically protected by the use of cathodic protection. This means that sacrificial anodes are disposed at spaced locations along its length. The continued presence and effectiveness of the anodes is essential to the functioning of the cathodic protection. Thus, to ensure the continued integrity of the pipe itself, the anodes must be regularly inspected. At present this is either done by the use of remotely operated vehicles and/or potential surveys. Each of these methods is extremely costly and can only be performed when weather conditions allow.

In many circumstances where subsea pipeline systems are used, there is a desire to operate equipment at locations which, in the general sense, are remote. That is to say, although the equipment is situated adjacent to the pipeline itself it is not near any other facility or infrastructure. Such pieces of equipment might, for example, be sensors which monitor the integrity or operation of the pipeline system.

One of the problems with such remote pieces of equipment is providing a suitable power source. Whilst batteries can be used these are unattractive for various reasons including their limited life, their expense and environmental concerns.

It is an object of this invention to provide an anode integrity monitoring technique which alleviates at least some of the problems of the existing techniques.

It will be appreciated that the anodes may become non-effective in a number of ways, for example the anode may become totally detached from the pipeline, it may lose effective electrical contact with the pipeline or may have disintegrated to such an extent that it ceases to be effective. It is desirable to be able to detect when any of these events has occurred.

It is another object of the present invention to provide methods, systems and apparatus which allow the supply of power to remote equipment in subsea pipeline systems.

According to a first aspect of the present invention there is provided an anode monitoring system for monitoring the integrity of anodes provided on a metallic structure for cathodic protection purposes comprising a signal circuit having at least one signal path comprising the metallic structure and a selected anode whereby the characteristics of the signal circuit depend on the effectiveness of the selected anode, signal generation means for generating and applying a signal to the signal circuit, and a central station for monitoring signals on the signal circuit to thereby determine whether the selected anode is effective.

According to a second aspect of the present invention there is provided an anode monitoring method for monitoring the integrity of anodes provided on a metallic structure for cathodic protection purposes comprising the steps of:

generating a signal and applying said signal to a signal circuit, the signal circuit comprising at least one signal path comprising the metallic structure and a selected anode whereby the characteristics of the signal circuit depend on the effectiveness of the selected anode; and monitoring signals on the signal circuit at a central station to thereby determine whether the selected anode is effective.

Preferably the signal generating means is arranged, when the selective anode is effective, to apply a signal to the signal circuit which is indicative of the effectiveness of the selected anode.

Preferably the signal generating means, or at least one component thereof is disposed at the selected anode.

The absence or defectiveness of the selected anode may be detectable as a break in the signal circuit. The break in the circuit may be detectable as the result of an inability to apply a signal to the signal circuit and/or an inability to receive a signal from the circuit. The absence or defectiveness of the selected anode may be detectable due to the absence of an expected signal. The expected signal may be that resulting from a change in the effective impedance of the signal circuit.

The signal circuit may comprise a return path via earth. Preferably the selected anode, when effective, provides a conduction path from the metallic structure to earth. Where the selected anode provides a path to earth, the absence or defectiveness of the selected anode may be detectable as the loss of an earth connection.

The signal circuit may comprise impedance means. The impedance means may be disposed between the selected anode and the remainder of the metallic structure. The impedance means may be provided in series between the selected anode and the metallic structure.

The impedance means may comprise isolation means.

The impedance means may comprise inductance means. The impedance means may comprise filter means. The impedance means may be arranged to give a high impedance to time varying signals within one or more selected ranges of frequencies and a low impedance to signals outside the selected range or ranges. The impedance means can be arranged so that the real part of the impedance is substantially zero. This means that there is little or no attenuation of the dc components of signals passing through the impedance means.

The use of inductance means and/or filter means has advantages when the metallic structure is used to carry signals because these means can be chosen to offer high impedance to the time varying signals used for signalling thereby reducing losses, whilst offering low impedance to the currents used for cathodic protection.

Transmitting means and receiving means may be provided for allowing data to be transmitted along the metallic structure. The transmitting and receiving means may be provided to assist the anode monitoring operation and/or to provide a distinct data transmission function.

The transmitting means and/or receiving means may be connected across the impedance means and arranged to transmit and/or receive signals across the impedance means.

Where signals are received across the impedance means, the use of filter means as the impedance means has an additional advantage that noise generated outside the frequency band of interest will be attenuated before it enters the receiver.

In some embodiments the signal generating means comprises transmitting means, the signal circuit comprises an earth return path so that the transmitting means requires an earth connection and the selected anode is arranged, when effective, to provide the earth connection so allowing transmission of a signal indicative of the anode's effectiveness which is detectable at the central station. When the selected anode is defective or absent the transmitting means has no earth reference so that no signal is transmittable by the transmitting means. Therefore if the signal is absent it can be determined that the selected anode is defective or absent. In such embodiments the transmitting means is preferably connected across the impedance means.

In other embodiments the signal generating means comprises reference signal generating means arranged to apply a reference signal to the signal circuit and effective impedance varying means for varying the effective impedance of the signal circuit in accordance with data to be transmitted, the central station comprises monitoring means for monitoring changes in the reference signal caused by varying the effective impedance of the signal circuit and the signal circuit is arranged such that defectiveness or absence of the selected anode causes a break in the signal circuit whereby non-effectiveness of the selected anode is detectable at the central station due to the absence of changes in the reference signal.

In such embodiments the reference signal generating means may be arranged to be locatable at a position which is remote from the selected anode. The impedance varying means may be located adjacent the selected anode.

Preferably the signal circuit comprises a plurality of signal paths each comprising the metallic structure and a respective anode. The subsidiary features defined above in relation to the selected anode apply equally to each of the respective anodes in a system with a plurality of signal paths. Independent signal generating means or at least one independent component of the signal generating means may be disposed at each anode.

Different data and/or a different signal and/or a different frequency may be associated with each of the respective anodes. The system may be arranged so that signals associated with each anode are generated at different times. The signals may be randomly generated. In this way, for example, when a particular anode is non-effective and hence its associated data/signal is not received at the central station it is possible to determine which anode it is which is non-effective.

According to a third aspect of the present invention there is provided a data transmission system comprising transmitting means, receiving means and a metallic structure which is primarily intended for another purpose but which in use acts as a signal channel between the transmitting means and the receiving means, wherein the metallic structure includes at least one anode provided for cathodic protection purposes and impedance means are disposed between the metallic structure and the anode.

The data transmission system may comprise a signal circuit comprising the metallic structure and a return path. The return path may be via earth. The signal circuit may comprise the anode. Preferably the anode provides a path from the metallic structure to earth.

The impedance means may be provided in series between the respective anode and the metallic structure.

The impedance means may comprise inductance means. The impedance means may comprise filter means. The impedance means may be arranged to have a high impedance to time varying signals within one or more selected ranges of frequencies and a low impedance to signals outside the selected range or ranges. The use of the inductance means or filter means gives the advantages discussed above.

According to a fourth aspect of the present invention there is provided apparatus for use with a metallic structure in carrying out the first, second or third aspects of the invention.

In all of the above aspects of the invention the metallic structure may comprise a pipeline, for example, a subsea pipeline of the type used for conveying oil or gas. The metallic structure may comprise a processing plant and/or a tree and/or a manifold.

According to a fifth aspect of the present invention there is provided a subsea pipeline power transmission system comprising a pipeline, an electrical power supply connected to the pipeline at a first location, and connection means provided on the pipeline at a second location for connection of a load to the pipeline to allow the load to receive electrical power from the power supply via the pipeline wherein the pipeline has a plurality of cathodic protection anodes, each of which is electrically connected via respective impedance means to the pipeline.

According to a sixth aspect of the present invention there is provided a method of subsea pipeline power transmission along a pipeline having a plurality of cathodic protection anodes comprising the steps of:

applying electrical power to the pipeline at a first location; and electrically connecting a load to be supplied to the pipeline at a second location;

wherein each anode is electrically connected via respective impedance means to the pipeline.

According to a seventh aspect of the present invention there is provided apparatus for use in a subsea pipeline power transmission system or method comprising:

an anode arrangement comprising, a sacrificial anode arranged for mounting on a pipeline and impedance means having one terminal connected to the anode and another terminal arranged for connection to said pipeline; and an electrical power supply arranged for electrical connection to a pipeline.

According to an eighth aspect of the present invention there is provided an anode arrangement for use in a subsea pipeline power transmission system, the arrangement comprising, a sacrificial anode arranged for mounting on a pipeline and impedance means having one terminal connected to the anode and another terminal arranged for connection to said pipeline.

The anode arrangement may include further terminals allowing the connection of a load across the impedance means.

The impedance means may comprise inductance means. Preferably the impedance means comprises filter means. The impedance means, especially when comprising filter means, may be arranged to give a high impedance to time varying signals within one or more selected ranges of frequencies and a low impedance to signals outside the selected range or ranges. The impedance means can be arranged so that the real part of the impedance is substantially zero. This means that there is little or no attenuation of the dc components of signals passing through the impedance means.

The use of inductance means and particularly filter means has advantages when the metallic structure is used to carry power currents because these means can be chosen to offer high impedance to the time varying signals used for power supply thereby reducing losses, whilst offering low impedance to the currents used for cathodic protection. Minimising losses is particularly important when transmitting power rather than merely trying to detect a signal. Limiting loss to a realistic level is necessary to give a practical system.

Figure 2:
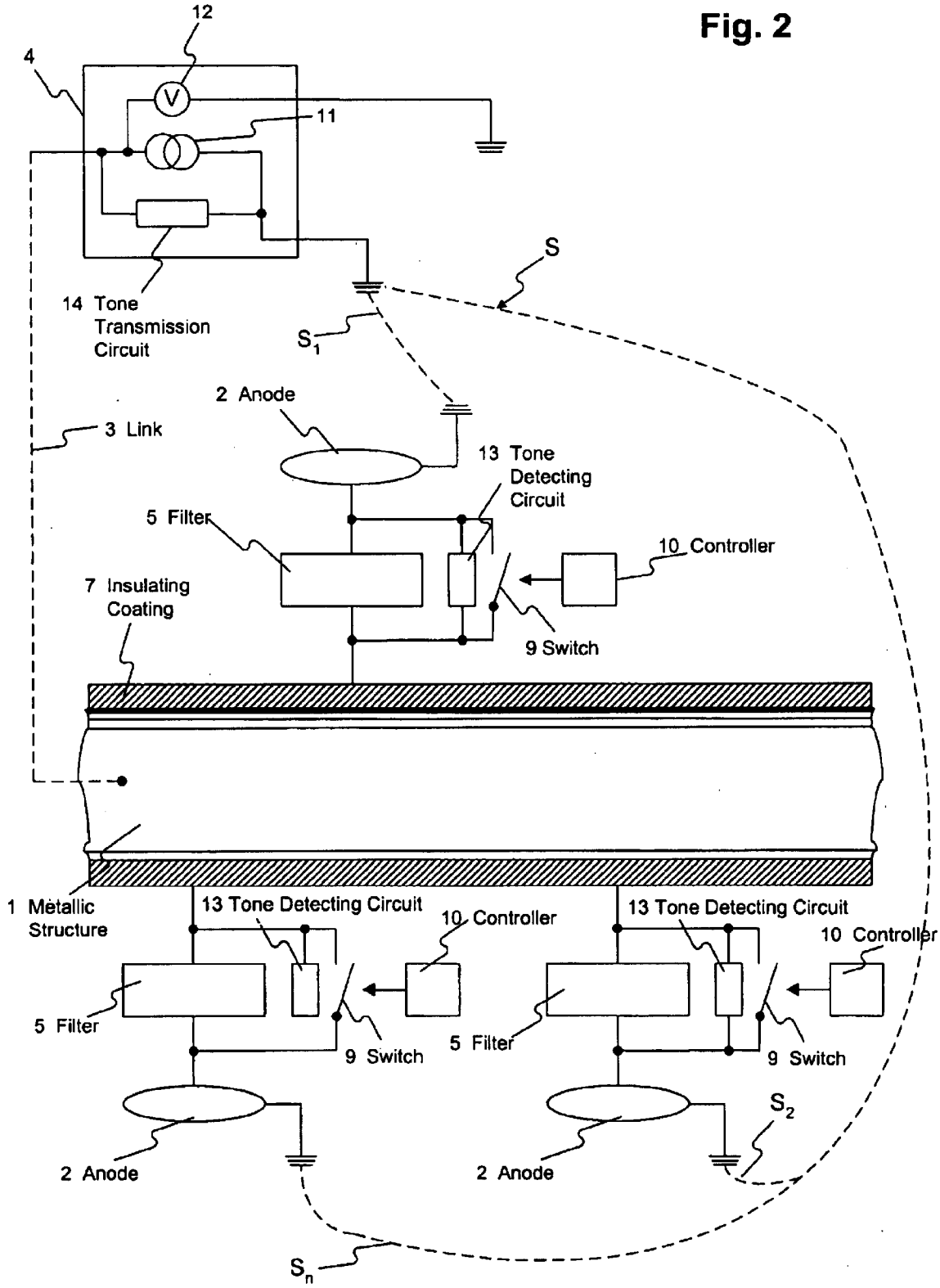

Embodiments of the present invention will now be described, by way of example only, with reference to the accompanying drawings in which:

FIG. 1 schematically shows a first anode monitoring system;

FIG. 2 schematically shows a second anode monitoring system; and

Figure 3:
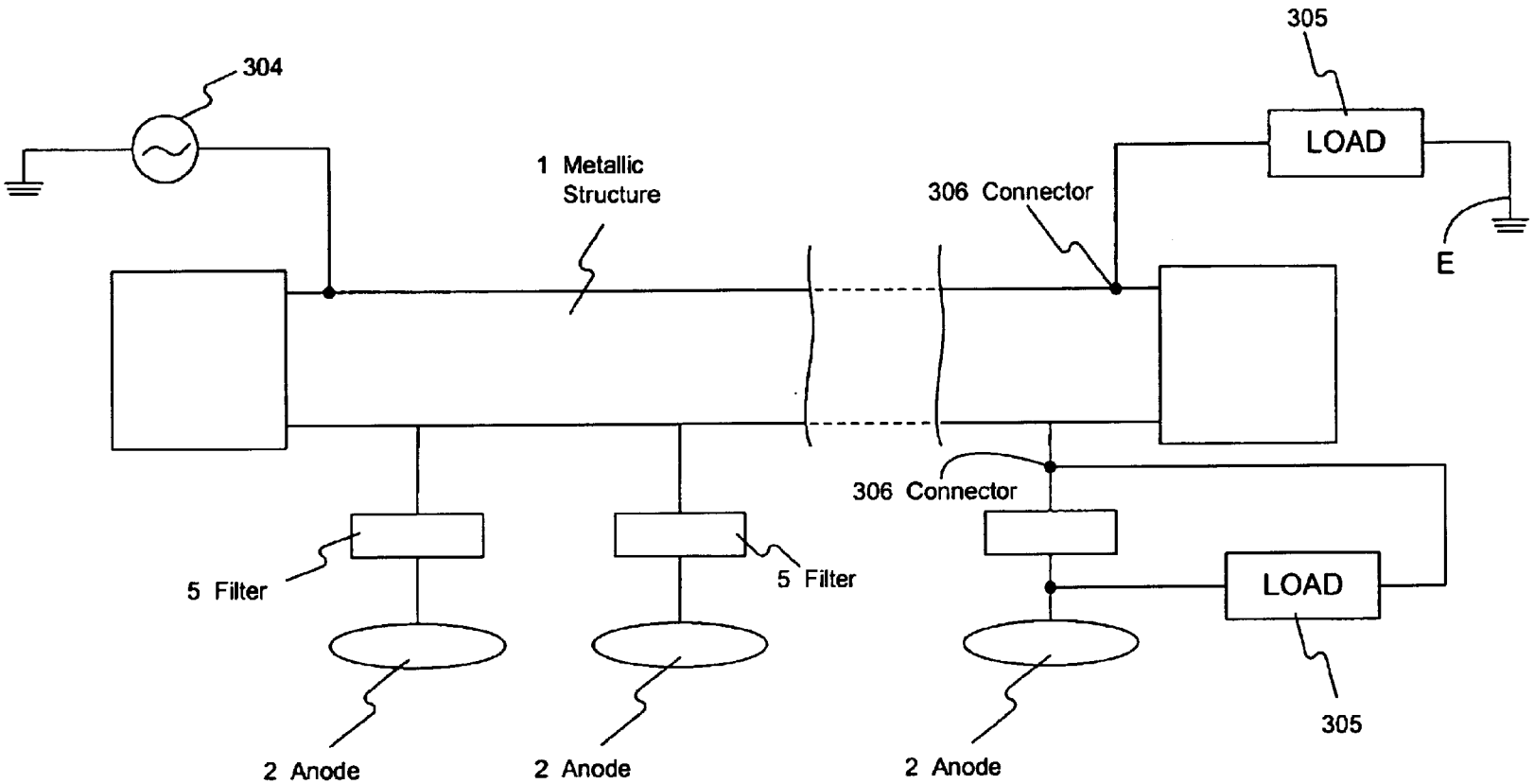

FIG. 3 schematically shows a pipeline system embodying a power transmission system of the invention.

FIG. 1 shows a first anode monitoring system which generally comprises a metallic structure consisting of a pipeline system 1 provided with a plurality of anodes 2 and connected via a link 3 to a central station 4. It will be appreciated that a pipeline system may be provided with a very large number of anodes 2 although only three are shown in FIG. 1.

Each anode 2 has an associated notch filter 5 connected in series between the respective anode 2 and the metallic structure 1. Further, each anode 2 has an associated transmitter 6 which acts as a signal generating means and which is connected across the respective notch filter 5.

The metallic structure 1 of the pipe is encased in an insulating coating 7. Thus the resistance between the metallic structure and the surrounding medium is high. There is a capacitance between the metallic structure 1 and the surrounding medium with the coating 7 acting as a dielectric. However, unless the frequency of signals is high enough that the capacitance comes into play, losses to the surroundings from the metallic structure 1 are almost exclusively through the anodes 2. Thus a signal circuit S comprising respective signal paths $S_1$–$S_n$ for each of the anodes 2 can be considered to exist. In each case the signal path $S_n$ comprises the metallic structure 1, the respective anode 2, the link 3 and a respective return path via earth to the central station 4.

The notch filter 5 associated with each of the anodes 2 is chosen to have a high impedance to signals of the frequency generated by the associated transmitter 6 but to give a low impedance to the currents applied to the metallic structure 1 for cathodic protection purposes. This means that when the respective anode 2 is present, the cathodic protection currents pass easily through the notch filter 5, allowing the cathodic protection system to work effectively. However, when transmitting a signal using the transmitter 6 there is effectively an open circuit between the metallic structure 1 and the respective anode 2 so that a signal can be transmitted along the metallic structure 1 with the anode 2 providing an earth reference for the transmitter 6.

On the other hand, if the respective anode 2 were not present the transmitter 6 would not have an earth reference, or to view it another way the earth return path would be broken, so that no signal would be received at the central station 4. The same is also true if the effectiveness of the anode 2 has been compromised in some other way. Thus by looking for the absence of an expected signal, it is possible to determine at the central location 4 that the anode 2 is not effective.

In a particular implementation each transmitter 6 is arranged to transmit a simple message at a random time during a selected period for example once a week. The time taken to transmit each message would be of the order of 5 seconds. Therefore in a system having say 50 anodes the total transmit time would be 250 seconds each week. Because of this, the probability of two transmitters 6 transmitting at the same time is very low and thus the chance of missing a signal from a functioning anode because of a clash is very low. In practise before deciding that an anode was not functioning a second or further missing signal would be waited for. In this way the probability of incorrectly diagnosing a faulty anode may be reduced to say 1 in 1,000,000. The random signalling technique is used because it is impractical to provide access to real time at each anode.

Each message has various components for example, Address (8 bits), Protocol overhead (8 bits), Error check (16 bits), Battery condition etc. (8 bits), measurement results (16 bits). The measurement results transmitted in the message may include the value of the current flowing through the respective anode and the potential difference between the anode and the metallic structure adjacent the anode. These measurements can help in assessing the condition of the associated metallic structure and other anodes. In alternatives each transmitter 6 can be arranged to transmit at a distinct frequency from each of the other transmitters and/or to transmit a simple message which is unique to a particular anode 2. The central station 4 can then look for a plurality of different signals and be arranged to indicate precisely which anode it is which is missing when a particular signal is absent. In such alternatives the notch filter 5 is replaced by a band stop filter chosen to give high impedance to each of the different frequencies used.

In other alternatives the notch filter 5 may be replaced with another circuit element, for example an inductor, which has the necessary properties of providing high impedance to the signals to be transmitted whilst providing low impedance to the cathodic protection currents.

FIG. 2 shows a second anode monitoring system which is similar to the first anode monitoring system shown in FIG. 1 but which uses a different signal transmission technique. In the first anode monitoring system it is necessary to have a source of power at each of the anodes 2 which can be used to drive the respective transmitter 6. Because of the length of the pipelines on which the system would typically be used and the losses inherent with the type of signal transmission used, the power demands are high. These power demands can be met by the use of one-shot batteries but this means that the system can function only for a limited period before the batteries have to be replaced.

In the second monitoring system shown in FIG. 2, the power source necessary for transmitting signals from each of the anodes can be provided at a location remote from the anodes. However, a power source may be provided at each anode to drive the electronics disposed at the anode. The power requirements of any such electronics, however, will be very small compared with that required for transmitting signals.

The second anode monitoring system generally comprises the metallic structure of a pipeline 1 provided with a plurality of anodes 2 at spaced locations and connected via a link 3 to a central station 4. Each of the anodes 2 is connected to the metallic structure 1 via a notch filter 5 and a bypass loop having a switch 9. When the switch 9 is open the only conduction path between the metallic structure 1 and the respective anode 2 is through the notch filter 5 but when the switch 9 is closed there is a free conduction path. A tone detecting circuit 13 is connected across each filter 5. Each switch 9 has an associated control means 10 which is arranged to open and close the switch 9 in dependence on data which is to be transmitted. The switch 9 and control means 10 act as an impedance varying means.

The central station 4 comprises a current source 11, which acts as a reference signal generating means, a first terminal of which is connected via the link 3 to the metallic structure 1 and a second terminal of which is connected to earth, and voltage measuring means 12, one terminal of which is connected to the first terminal of the current source 11 and the other terminal of which is connected to a reference earth. A tone transmitting circuit 14 is connected across the current source.

The pipeline has an insulating layer 7 and a signal circuit S having respective signal paths $S_1$–$S_n$ associated with each of the anodes 2 can be considered to exist. Each signal path $S_n$ comprises the respective anode 2, the metallic structure 1, the link 3 and a respective earth return path.

In the normal situation the signal paths $S_n$ are completed via the notch filter 5. In this way there is a current path from the metallic structure 1 to the anode 2 which allows the cathodic protection system to function because the notch filter 5 offers substantially no impedance to the cathodic protection currents. However, the notch filter is chosen to have high impedance to reference signals generated by the current source 11. When it is desired to send a signal from a particular anode 2, a reference signal is applied to the signal circuit and the control circuit 10 operates the respective switch 9 to encode data onto the signal circuit S. Whilst all of the switches 9 are open there are only earth return paths to the second terminal of the current source 11 through the insulating layer and through the notch filters 5. However, when the switch associated with a particular anode is closed the effective impedance of the signal circuit S as a whole is reduced significantly for the reference signal because the respective notch filter 5 is by-passed. Thus the effective impedance can be varied by opening and closing the switch to encode data onto the signal circuit. The voltage measuring means 12 at the central station 4 is used to detect resulting changes in potential difference between the first terminal of the current source 11 and earth as the switch 9 is opened and closed. The control means 10 associated with each anode 2 is used to code a signal onto the signal circuit S which is indicative of the respective anode. Thus the central station 4 can look for a particular signal to confirm the effectiveness of a particular anode 2. However, if that anode 2 is not present, then opening and closing the switch 9 will not change the effective impedance of the signal circuit and correspondingly no change in potential difference at the central station 4 will be detected.

The transmission of signals from the anodes is controlled in the manner described below. The tone transmitting circuit 14 transmits a tone along the metallic structure 1. The tone is detected by each of the tone detecting circuits 13. Each tone detecting circuit 13 is arranged to emit a trigger signal to the respective control means 10 after a predetermined period has elapsed. Once the respective control means 10 has received the trigger signal it is caused to operate to encode the desired data onto the metallic structure. The predetermined period for each tone detecting circuit 13 is different so that signals from each anode 2 are transmitted at different times. The time at which a signal should be received from each anode 2 is known and thus signals can be looked for at these times at the central station. The absence of a particular signal gives an indication that the corresponding anode 2 is non-effective.

In alternatives of each anode monitoring system the central station 4 is equipped with transmitting means (not shown) which are capable of transmitting instructions specific to particular anodes to cause the respective transmitters 6 or control means 10 to operate on command. Typically, the central station 4 transmits a series of individual signals each of which causes the electronics associated with a particular anode to generate a signal which can then be looked for at the central station 4.

FIG. 3 illustrates another embodiment of the invention and shows a subsea pipeline system which comprises a pipeline 1 provided with a plurality of anodes 2 which are electrically connected to the pipeline 1 via respective filters 5.

A power supply 304 is electrically connected to the pipeline 1 towards one end. This location will typically be at a main facility or some other place provided with good infrastructure such that the provision of a power supply 304 is not problematic.

Although not shown in detail, as is common practice in this field, the pipeline system is provided with a cathodic protection system of which the anodes 2 form an essential part. Cathodic protection currents flowing in the pipeline 1 to improve corrosion resistance will be dc currents. Thus, the filters 5 provided at each anode are arranged to have substantially zero impedance to dc currents.

On the other hand, the filters are arranged to have a very high impedance to the power supply currents delivered by the power supply means 304. In this system the power supply means applies a current typically having a frequency in the order of 30 to 100 Hz. The filters 5 are arranged to have a high impedance to signals having the appropriate frequencies in this range. Each filter 5 may be designed so that at the transmission frequency it gives an impedance of at least two orders of magnitude greater than the characteristic impedance of the pipeline (with anodes removed) when acting as a transmission system. This means that whilst the cathodic protection currents can flow to the anode substantially unimpeded, the losses from the pipeline 1 as far as the power supply current is concerned are greatly reduced.

The frequency of current used to transmit power is chosen with regard to two main factors. Lower frequencies call for more bulky and expensive components in the filter means whereas as frequency is increased, skin effect in the pipeline becomes problematic. The frequency at which skin effect begins to compromise performance may be determined empirically on a test length of pipe but can be expected to be in the range of 50 to 100 Hz for most typical pipes.

The above arrangement means that loads 305, i.e., pieces of equipment which need electrical power, can be connected via suitable connectors, schematically illustrated at 306, to the pipeline 1 at locations which are remote from the power supply 304. As shown in FIG. 3, a load 305 may, for example, be connected directly to the pipeline 1 and provided with a separate earth terminal E, or may be connected directly across the filter 5 associated with a particular anode 2 where the equipment to be driven is located at or near an anode 2.

The provision of suitable impedance means, preferably as in this embodiment a filter 5, between the pipeline 1 and the anode 2 makes a power supply system of this type feasible. For example, if no filters 5 are provided, then power supply in this manner might be possible in a subsea pipeline over a distance of say only 300 to 400 metres. However, with the filters included, it can be possible to transmit power over a distance of say 10 kilometres. In the present system the loss of power might typically be in the order of 0.5 to 1 dB per kilometre and as such, if the power supply 304 applies 150 watts to the pipeline 1 then a load at a 10 kilometre distance from the power supply 304 should be able to draw a power in the order of 50 to 15 watts. It has been determined that effectively stopping leakage from the anodes gives a $10^4$ improvement in power transmission capabilities over 10 kilometre subsea pipelines.

It will be appreciated that although an ac current is applied to the pipeline 1 for transmission, this signal may be locally converted into a dc signal using known techniques if this is required.

What is claimed is:

1. An anode monitoring system for monitoring the integrity of anodes provided on a metallic structure for cathodic protection purposes, the system comprising a signal circuit having at least one signal path comprising the metallic structure and a selected anode whereby the characteristics of the signal circuit depend on the effectiveness of the selected anode, a signal generator for generating and applying a signal to the signal circuit, and a central station for monitoring signals on the signal circuit to thereby determine whether the selected anode is effective, the arrangement being such that at least one of absence and defectiveness of the selected anode is detectable due to the absence of an expected signal.

2. An anode monitoring system according to claim 1 in which the signal generator is arranged, when the selective anode is effective, to apply a signal to the signal circuit which is indicative of the effectiveness of the selected anode.

3. An anode monitoring system according to claim 1 in which the signal generator is disposed at the selected anode.

4. An anode monitoring system according claim 1 which the signal circuit comprises a return path via earth and the selected anode, when effective, provides a conduction path from the metallic structure to earth.

5. An anode monitoring system according to claim 1 in which the signal circuit comprises an impedance element provided in series between the selected anode and the metallic structure.

6. An anode monitoring system according to claim 5 in which the impedance element is arranged to give a high impedance to time varying signals within at least one selected range of frequencies and a low impedance to signals outside the selected range.

7. An anode monitoring system according to claim 6 in which the impedance element is arranged so that the real part of the impedance is substantially zero.

8. An anode monitoring system according to claim 5 further comprising at least one of a transmitter and a receiver connected across the impedance means and arranged to respectively transmit and receive signals across the impedance means.

9. An anode monitoring system according to claim 1 in which the signal generator comprises a reference signal generator arranged to apply a reference signal to the signal circuit and an effective impedance varier for varying the effective impedance of the signal circuit in accordance with data to be transmitted wherein the reference signal generator is located at a position which is remote from the selected anode and the impedance varier is located adjacent the selected anode.

10. An anode monitoring system according to claim 1 which comprises a plurality of signal paths each comprising the metallic structure and a respective anode which is arranged so that signals associated with each anode are generated at different, randomly determined, times.

11. An anode monitoring method for monitoring the integrity of anodes provided on a metallic structure for cathodic protection purposes comprising the steps of:

generating a signal and applying said signal to a signal circuit, the signal circuit comprising at least one signal path comprising the metallic structure and a selected anode whereby the characteristics of the signal circuit depend on the effectiveness of the selected anode; and monitoring signals on the signal circuit at a central station to thereby determine whether the selected anode is effective, the arrangement being such that at least one of absence and defectiveness of the selected anode is detectable due to the absence of an expected signal.

12. An anode arrangement for use in an anode monitoring system, the arrangement comprising a cathodic protection anode arranged for mounting on a metallic structure, an impedance element having one terminal connected to the anode and another terminal arranged for connection to said metallic structure, and an electronics module connected across the impedance element for at least one of transmitting and receiving signals.

13. An anode monitoring system for monitoring the integrity of anodes provided on a metallic structure for cathodic protection purposes, the system comprising a signal circuit having at least one signal path comprising the metallic structure and a selected anode whereby the characteristics of the signal circuit depend on the effectiveness of the selected anode, signal generation means for generating and applying a signal to the signal circuit, and a central station for monitoring signals on the signal circuit to thereby determine whether the selected anode is effective, the arrangement being such that at least one of absence and defectiveness of the selected anode is detectable due to the absence of an expected signal.

14. An anode monitoring system for monitoring the integrity of anodes provided on a metallic structure for cathodic protection purposes, the system comprising a signal circuit having at least one signal path comprising the metallic structure and a selected anode whereby the characteristics of the signal circuit depend on the effectiveness of the selected anode, a signal generator for generating and applying a signal to the signal circuit, and a central station for monitoring signals on the signal circuit to thereby determine whether the selected anode is effective, wherein the signal circuit comprises a return path via earth and the selected anode, when effective, provides a conduction path from the metallic structure to earth.

15. An anode monitoring system according to claim 14 in which the signal generator is arranged, when the selective anode is effective, to apply a signal to the signal circuit which is indicative of the effectiveness of the selected anode.

16. An anode monitoring system according to claim 14 in which the signal generator is disposed at the selected anode.

17. An anode monitoring system according to claim 14, the arrangement being such that at least one of absence and defectiveness of the selected anode is detectable due to the absence of an expected signal.

18. An anode monitoring system according to claim 14 in which the signal circuit comprises an impedance element provided in series between the selected anode and the metallic structure.

19. An anode monitoring system according to claim 18 in which the impedance element is arranged to give a high impedance to time varying signals within at least one selected range of frequencies and a low impedance to signals outside the selected range.

20. An anode monitoring system according to claim 19 in which the impedance element is arranged so that the real part of the impedance is substantially zero.

21. An anode monitoring system according to claim 19 further comprising at least one of a transmitter and a receiver connected across the impedance element and arranged to respectively transmit and receive signals across the impedance element.

22. An anode monitoring system according to claim 14 in which the signal generator comprises a reference signal generator arranged to apply a reference signal to the signal circuit and an effective impedance varier for varying the effective impedance of the signal circuit in accordance with data to be transmitted wherein the reference signal generator is located at a position which is remote from the selected anode and the impedance varier is located adjacent the selected anode.

23. An anode monitoring system according to claim 14 which comprises a plurality of signal paths each comprising the metallic structure and a respective anode which is arranged so that signals associated with each anode are generated at different, randomly determined, times.

24. An anode monitoring method for monitoring the integrity of anodes provided on a metallic structure for cathodic protection purposes comprising the steps of:

generating a signal and applying said signal to a signal circuit, the signal circuit comprising at least one signal path comprising the metallic structure and a selected anode whereby the characteristics of the signal circuit depend on the effectiveness of the selected anode; and monitoring signals on the signal circuit at a central station to thereby determine whether the selected anode is effective, wherein the signal circuit comprises a return path via earth and the selected anode, when effective, provides a conduction path from the metallic structure to earth.

25. An anode monitoring system for monitoring the integrity of anodes provided on a metallic structure for cathodic protection purposes, the system comprising a signal circuit having at least one signal path comprising the metallic structure and a selected anode whereby the characteristics of the signal circuit depend on the effectiveness of the selected anode, signal generation means for generating and applying a signal to the signal circuit, and a central station for monitoring signals on the signal circuit to thereby determine whether the selected anode is effective, wherein the signal circuit comprises a return path via earth and the selected anode, when effective, provides a conduction path from the metallic structure to earth.

* * * * *